US008616831B2

(12) United States Patent
Wollstadt et al.

(10) Patent No.: US 8,616,831 B2
(45) Date of Patent: Dec. 31, 2013

(54) SIMPLIFIED HOUSING FOR A FUEL CELL COMPRESSOR

(75) Inventors: Thomas Wollstadt, Bad Camberg (DE); Grant William Brady, Howell, MI (US); Gary L. Villeneuve, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1139 days.

(21) Appl. No.: 12/539,040

(22) Filed: Aug. 11, 2009

(65) Prior Publication Data

US 2011/0038719 A1 Feb. 17, 2011

(51) Int. Cl.
*F01D 25/24* (2006.01)
*F01D 3/00* (2006.01)

(52) U.S. Cl.
USPC ..... 415/104; 415/107; 415/214.1; 29/888.02; 29/888.022

(58) Field of Classification Search
USPC ..... 415/104, 105, 206, 214.1, 229, 106, 415/107; 29/888.02, 888.022, 888.023
See application file for complete search history.

(56) References Cited

U.S. PATENT DOCUMENTS

| | | | | |
|---|---|---|---|---|
| 4,137,006 | A * | 1/1979 | Becker | 415/201 |
| 4,355,850 | A * | 10/1982 | Okano | 384/121 |
| 5,310,311 | A * | 5/1994 | Andres et al. | 415/229 |
| 5,857,348 | A * | 1/1999 | Conry | 62/209 |
| 7,700,207 | B2 * | 4/2010 | Hild | 429/415 |
| 2008/0232962 | A1 * | 9/2008 | Agrawal et al. | 415/214.1 |

FOREIGN PATENT DOCUMENTS

| | | | |
|---|---|---|---|
| DE | 1104342 | B | 4/1961 |
| DE | 102007052831 | A1 | 5/2008 |
| JP | 2003174742 | A | 6/2003 |
| WO | 2008086826 | A1 | 7/2008 |

* cited by examiner

*Primary Examiner* — Edward Look
*Assistant Examiner* — Jason Davis
(74) *Attorney, Agent, or Firm* — Fraser Clemens Martin & Miller LLC; J. Douglas Miller

(57) ABSTRACT

A compressor includes a shaft assembly including a thrust disk disposed on a main shaft and a housing having a first portion and a second portion, the first and second portions adapted to receive the shaft assembly and enclose the shaft assembly therebetween, wherein the shaft assembly is rotatably disposed within the housing, and wherein at least one of the first portion and the second portion includes a shaft assembly retention feature for receiving the thrust disk to regulate a motion of the shaft assembly.

18 Claims, 4 Drawing Sheets

SIMPLIFIED HOUSING FOR A FUEL CELL COMPRESSOR

FIELD OF THE INVENTION

The invention relates to fuel cell systems. More particularly, the invention is directed to a compressor for a fuel cell system and a method for producing the compressor.

BACKGROUND OF THE INVENTION

A state of the art fuel cell compressor is typically equipped with air bearings in order to generate an oil-free air supply for the fuel cell stack. An axial air bearing (thrust bearing) is located close to a compressor stage and requires a static housing part disposed adjacent a front side of the thrust bearing and between a rotating compressor impeller and a rotating thrust disk.

Typically, all rotating components of the compressor are located together on a common shaft assembly which is high precision balanced prior to assembly of the compressor. Once balanced, the shaft assembly must not be disassembled in order to maintain the balance thereof. One issue is that the static front side of the thrust bearing must become part of the shaft assembly since the conventional thrust bearing cannot be placed in position after the rotating components are assembled.

It would be desirable to develop a compressor and a method of producing the compressor, wherein the compressor includes a split housing having a first portion and a second portion to enable balancing of a rotating shaft assembly without having a thrust bearing hanging loose on the shaft assembly.

SUMMARY OF THE INVENTION

Concordant and consistent with the present invention, a compressor and a method of producing the compressor, wherein the compressor includes a split housing having a first portion and a second portion to enable balancing of a rotating shaft assembly without having a thrust bearing hanging loose on the shaft assembly, has surprisingly been discovered.

In one embodiment, a compressor comprises a shaft assembly including a thrust disk disposed on a main shaft and a housing having a first portion and a second portion, the first and second portions adapted to receive the shaft assembly and enclose the shaft assembly therebetween, wherein the shaft assembly is rotatably disposed within the housing, and wherein at least one of the first portion and the second portion includes a shaft assembly retention feature for receiving the thrust disk to regulate a motion of the shaft assembly.

In another embodiment, a compressor comprises: a shaft assembly including a thrust disk disposed on a main shaft; a housing having a first portion and a second portion, the first and second portions adapted to receive the shaft assembly and enclose the shaft assembly therebetween, wherein the shaft assembly is rotatably disposed within the housing, and wherein each of the first portion and the second portion includes a shaft assembly retention feature for receiving the thrust disk to regulate a motion of the shaft assembly; and a thrust air bearing having a first component and a second component, wherein the first component of the thrust air bearing is disposed in the first portion of the housing between the shaft assembly retention feature and the thrust disk and the second component of the thrust air bearing is disposed in the second portion of the housing between the shaft assembly retention feature and the thrust disk.

The invention also provides methods for producing a compressor.

One method comprises the steps of providing a first portion of a housing adapted to receive a shaft assembly of the compressor, wherein the shaft assembly includes a thrust disk; rotatably disposing the shaft assembly in the first portion of the housing; providing a second portion of the housing adapted to receive the shaft assembly of the compressor; and coupling a second portion of the housing to the first portion to enclose the shaft assembly therebetween, wherein at least one of the first portion and the second portion includes a shaft assembly retention feature for receiving the thrust disk to regulate a motion of the shaft assembly.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
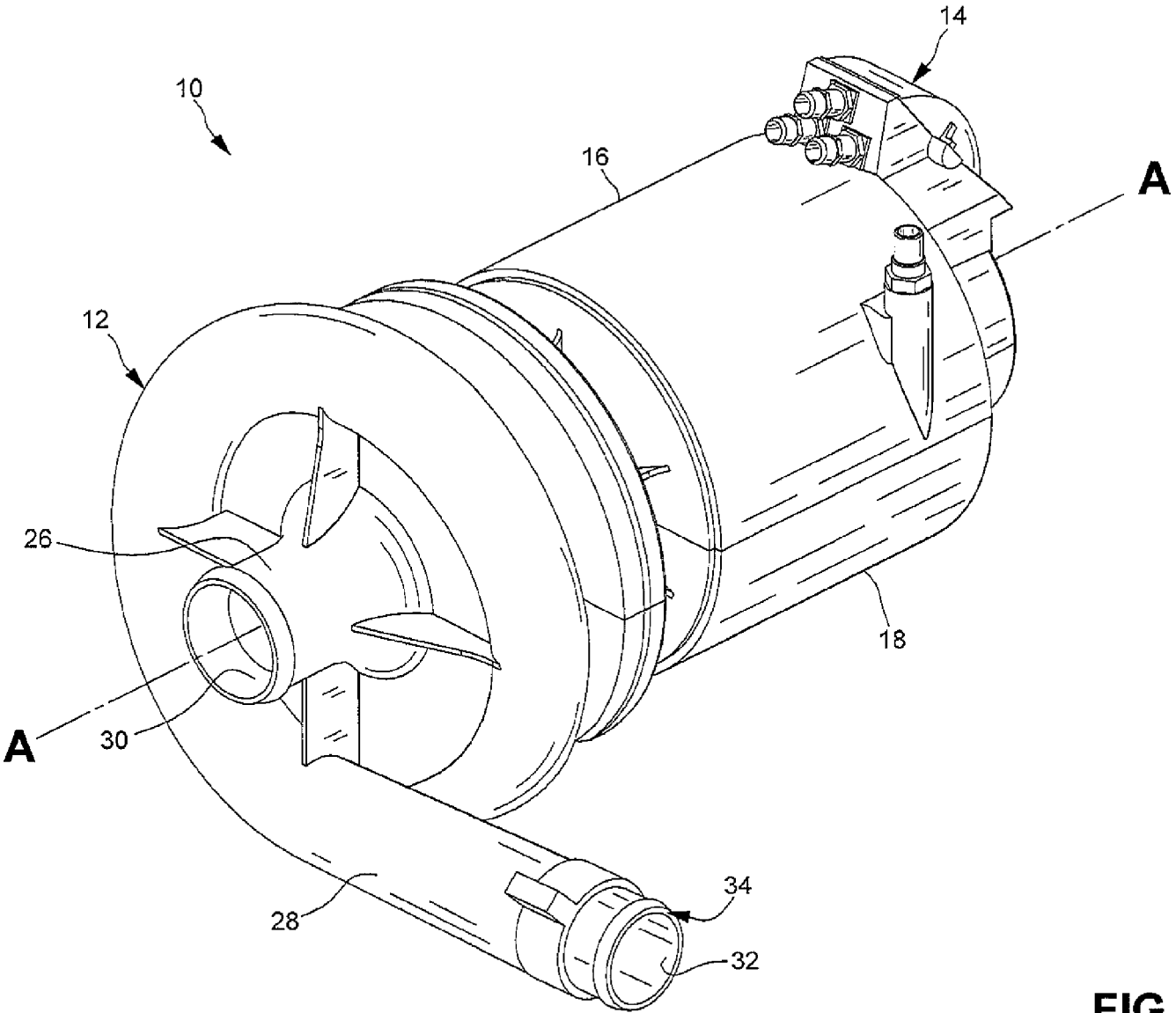
FIG. 1 is a perspective view of a compressor according to an embodiment of the present invention.
Figure 2:
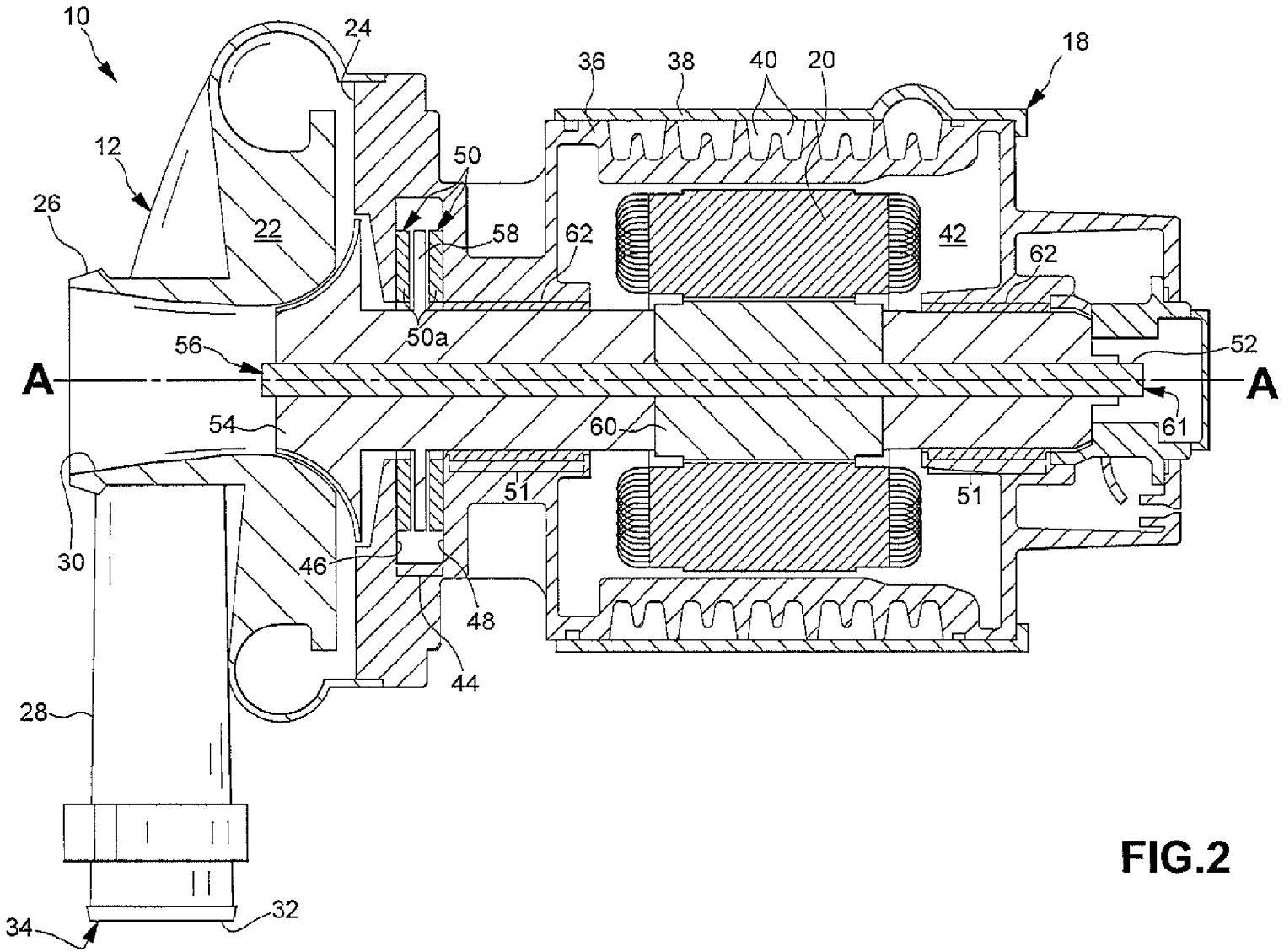
FIG. 2 is a top cross sectional view of the compressor of FIG. 1.
Figure 3:
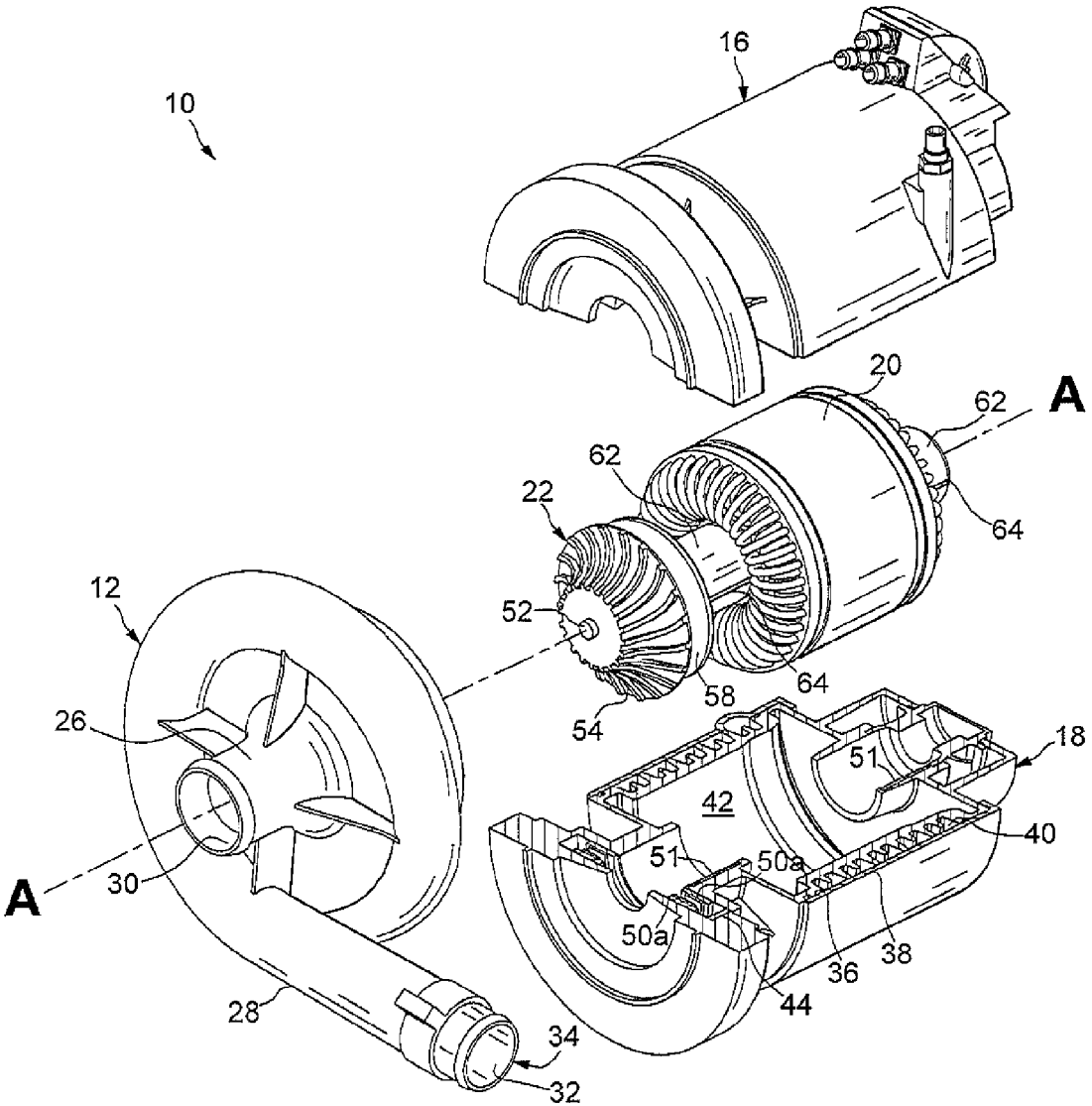
FIG. 3 is an exploded perspective view of the compressor of FIG. 1.
Figure 4:
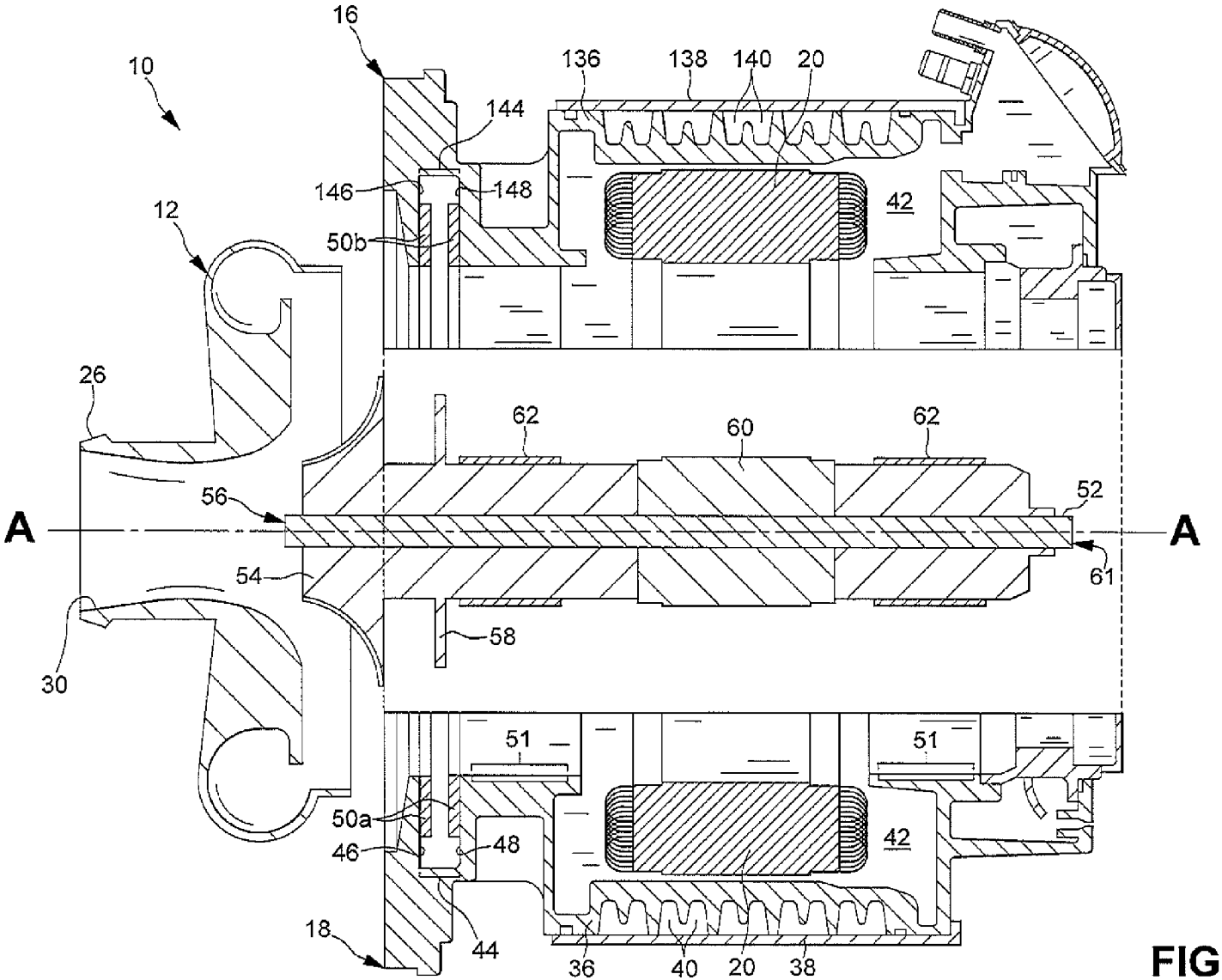
FIG. 4 is an exploded side cross sectional view of the compressor of FIG. 1.

FIGS. 1-4 illustrate a compressor 10 according to an embodiment of the present invention. The compressor 10 is typically incorporated into a fuel cell system (not shown) for a vehicle. However, the compressor 10 may be used with other systems and applications. As shown, the compressor 10 includes a volute 12 coupled to a split housing 14 having a first portion 16 and a second portion 18. As more clearly shown in FIG. 2, the compressor 10 further includes a motor 20 and a shaft assembly 22. It is understood that the compressor 10 may include additional components such as seals, electrical circuitry, and temperature regulating elements, for example.

The volute 12 is coupled to a first end 24 of the housing 14 for receiving and directing a flow of a fluid. As a non-limiting example, the volute 12 is coupled to the housing 14 using fasteners and retention devices such as those manufactured under the trademark Axi-rad®. As a further example, the fasteners may be formed integrally with at least one of the volute 12, the first portion 16, and the second portion 18. Other means for coupling the components may be used. As shown, the volute 12 has a unitary body 26 including a fluid conduit 28 having an inlet port 30 and an outlet port 32. The inlet port 30 is disposed along a central axis A-A of the compressor 10. The outlet port 32 is disposed at an outlet end 34 of the fluid conduit 28. In the embodiment shown, the fluid conduit 28 has a substantially spiral shape. However, it is understood that the volute 12 and the associated fluid conduit 28 may have a shape, size, and cross sectional area. As a non-limiting example, the volute 12 may be formed from a plurality of components such as an upper volute component and a lower volute component, wherein the combination of the volute components provides substantially the same operation as a volute having a unitary body.

As shown, each of the first portion 16 and the second portion 18 respectively include a main body 36, 136, a cooling mantle 38, 138, and a plurality of coolant channels 40, 140 formed between the main body 36, 136 and cooling mantle 38, 138. The main body 36, 136 of each of the housing portions 16, 18 is formed to receive particular components of the compressor 10 such as the motor 20 and the shaft assembly 22, for example. As a further example, an interior wall of the main body 36, 136 defines a motor cavity 42 adjacent the coolant channels 40, 140.

The main body 36, 136 of each of the housing portions 16, 18 includes a shaft assembly retention feature 44, 144 having a front side wall 46, 146 and a rear side wall 48, 148. As shown, the shaft assembly retention feature 44, 144 is a substantially disk shaped channel. However, the shaft assembly retention feature 44, 144 may have any shape and size. Additionally, a thrust air bearing 50 or "gas bearing" is disposed adjacent each of the front side wall 46, 146 and the rear side wall 48, 148 of the shaft assembly retention feature 44, 144. However, any structure may be used to provide a static mounting surface for the thrust air bearings 50. In certain embodiments, each of the thrust air bearings 50 is divided into a first component 50*a* and second component 50*b*. As a non-limiting example, the first component 50*a* of each of the thrust air bearings 50 has a semi-circular disc shape. Likewise, the second component 50*b* of each of the thrust air bearings 50 has a semi-circular disc shape corresponding to an associated first component 50*a*. However, it is understood that the thrust air bearings 50 may have any size and shape and may be divided into any portion, components, and shapes thereof. The main body 36, 136 of each of the housing portions 16, 18 may further include a plurality of retention features 51 for statically securing bearing components of the compressor 10. As a non-limiting example, the retention features 51 are retention slots. It is understood that the retention features 51 may have any size and shape. It is further understood that other retention features may be used.

The motor 20 is typically an electric stator motor adapted to drive the shaft assembly 22. However, other motors may be used. As shown, the motor 20 is disposed in the housing 14 adjacent the coolant channels 40, 140 formed in the main body 36, 136 of the housing 14. Additionally, the shaft assembly 22 is disposed through a central aperture (not shown) formed in the stator of the motor 20.

The shaft assembly 22 is disposed in the housing 14 and adapted to freely rotate therein. As shown, the shaft assembly 22 includes a main shaft 52 having an impeller 54 formed adjacent a first end 56 thereof and a thrust disk 58 spaced from the impeller 54. Additionally, a rotor 60 is disposed on the main shaft 52 and aligned with a portion of the motor 20. However, it is understood that any shaft assembly having any configuration or arrangement may be used and the split housing 14 may be formed to receive various shaft assemblies. As a non-limiting example, the impeller 54 and the thrust disk 58 may be coupled together by a tie rod and the remainder of the shaft assembly 22 formed into a long tube (not shown). As such, the rotor 60 is disposed inside the tube of the shaft assembly 22, wherein the tube is coupled to the tie rod. It is further understood that the main shaft 52 may have any size and shape and may be coupled to any component of the shaft assembly 22 using any configuration.

In certain embodiments, the thrust disk 58 is disposed adjacent a second end 61 formed opposite the first end 56. In other embodiments, an expander (not shown) is disposed adjacent the second end 61 and opposite the impeller 54 such that the expander functions to recover energy stored in a pressurized airstream and transforming the stored energy into rotational energy on the shaft (similar to a conventional turbocharger for combustion engines). It is understood that any number of thrust disks, rotors and impellers may be included. It is further understood that the impeller 54, the thrust disk 58, and rotor 60 may be positioned at any location along the main shaft 52.

In the embodiment shown, a plurality of journal bearings 62 is disposed on the main shaft 52 for supporting rotation of the shaft assembly 22 within the housing 14. As shown, two journal bearings 62 are disposed along the main shaft 52, one of the journal bearings 62 disposed on each side of the rotor 60. As a non-limiting example, the journal bearings 62 are an oil-free air bearing or "gas" bearing. As a further example, the journal bearings 62 may include a retention feature 64 formed integrally thereon. As shown, the retention feature 64 of each of the journal bearings 62 is a "key" protrusion or rib having a pre-determined shape to align with the corresponding retention feature 51 of the housing 14.

In use, the main shaft 52 of the shaft assembly 22 is formed with the impeller 54, the thrust disk 58, and the rotor 60. As such, the main shaft 52 is balanced for efficient rotation. Once balanced, the journal bearings 62 are guided onto the main shaft 52 and disposed in a pre-determined location associated with the retention features 51 of the housing 14. As a further non-limiting example, an error proofing step may be included to ensure that a rotation direction of the journal bearings 62 is appropriate. In certain embodiments, the main shaft 52 of the shaft assembly 22 is guided through the aperture of the motor 20 to "mount" the motor 20 around the rotor 60.

Meanwhile, the first portion 16 of the housing 14 is stabilized on an assembly bench or fixture and the first components 50*a* of the thrust air bearings 50 are coupled thereto. As a non-limiting example, one of the first components 50*a* of the thrust air bearings 50 is disposed on each of the front side wall 46 and the rear side wall 48 of the shaft assembly retention feature 44 formed in the first portion 16 of the housing 14. In certain embodiments, a sealing element (not shown) is disposed on the first portion 16 of the housing 14 to form a fluid-tight seal between the first portion 16 and the second portion 18 of the housing 14.

Once the first components 50*a* of the thrust air bearings 50 are secured, the shaft assembly 22 including the Journal bearings 62 is disposed in the second portion 18 of the housing 14. Specifically, each of the retention features 64 of the journal bearings 62 is aligned with the appropriate retention feature 51 of the housing 14 and the thrust disk 58 is received by the shaft assembly retention feature 44. As a non-limiting example, the retention features 51 are formed in the first portion 16 of the housing 14 such that the coupling of the first portion 16 and the second portion 18 secures the journal bearings 62 in a substantially static position.

Additionally, the second components 50*b* of the thrust air bearings 50 are coupled to each of the front side wall 146 and the rear side wall 148 of the shaft assembly retention feature 144 formed in the second portion 18 of the housing 14. The first portion 16 and the second portion 18 of the housing 14 are coupled together to enclose the motor 20 and the rotating shaft assembly 22 therebetween. As a non-limiting example, the first portion 16 and the second portion 18 of the housing 14 are coupled using fasteners and retention devices such as those manufactured under the trademark Axi-rad®. As a further example, the fasteners may be formed integrally with at least one of the volute 12, the first portion 16, and the second portion 18. Other means for coupling the components may be used. It is understood that an additional quality control step may be included to verify free rotational movement and appropriate axial and radial movement of the shaft assembly 22. The volute 12 is then coupled to the housing 14 to enclose the impeller 54 of the shaft assembly 22 and provide appropriate fluid dynamics.

The compressor 10 having the split housing 14 provides a means to balance the rotating shaft assembly 22 without having the thrust bearing 50 hanging loose thereon. Additionally, the compressor 10 provides retention features 51, 64 to minimize rotation of the journal air bearings 62. Further, the split housing 14 of the compressor 10 provides a means for simplified cooling system I/O and cavity sealing.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A compressor comprising:

a shaft assembly including a thrust disk disposed on a main shaft; and a housing having a first portion and a second portion, the first and second portions adapted to receive the shaft assembly and enclose the shaft assembly therebetween, wherein the shaft assembly is rotatably disposed within the housing, and wherein each of the first portion and the second portion includes a shaft assembly retention feature for receiving the thrust disk to regulate a motion of the shaft assembly, and wherein the shaft assembly retention feature is a channel formed in each of the first portion and the second portion of the housing, the channel having a front side wall defined by a first interior surface of the housing and a rear side wall defined by a second interior surface of the housing, the first interior surface spaced apart from the second interior surface and connected by a bottom surface of the channel, a gas bearing disposed within the shaft assembly retention features of the first portion and the second portion of the housing, the gas bearing including a pair of spaced apart first components and a pair of spaced apart second components, one of the first components spaced apart from the bottom surface and secured to the front side wall of the first portion of the housing and another of the first components spaced apart from the bottom surface and secured to the rear sidewall of the first portion of the housing, and one of the second components spaced apart from the bottom surface and secured to the front side wall of the second portion of the housing and another of the second components spaced apart from the bottom surface and secured to the rear sidewall of the second portion of the housing.

2. The compressor according to claim 1, further comprising a volute coupled to at least one of the first portion and the second portion, the volute including a fluid conduit for directing a flow of a fluid, wherein the flow of the fluid is generated by the shaft assembly.

3. The compressor according to claim 1, wherein the shaft assembly includes at least one of an impeller and a rotor.

4. The compressor according to claim 1, wherein at least one of the first portion and the second portion includes a cooling feature for dissipating heat generated by compressor.

5. The compressor according to claim 4, wherein the cooling feature is a plurality of cooling channels formed in at least one of the first portion and the second portion.

6. The compressor according to claim 1, further comprising a sealing element disposed between the first portion and the second portion of the housing.

7. The compressor according to claim 1, further comprising an oil-free air bearing disposed around a circumference of the shaft assembly.

8. The compressor according to claim 7, wherein at least one of the first portion and the second portion of the housing includes a retention feature for retaining the oil-free air bearing in a substantially static position.

9. The compressor according to claim 1, further comprising a motor having an aperture formed therein, wherein the main shaft of the shaft assembly is disposed through the aperture thereof.

10. A compressor comprising:

a shaft assembly including a thrust disk disposed on a main shaft;

a housing having a first portion and a second portion, the first and second portions adapted to receive the shaft assembly and enclose the shaft assembly therebetween, wherein the shaft assembly is rotatably disposed within the housing, and wherein each of the first portion and the second portion includes a shaft assembly retention feature for receiving the thrust disk to regulate a motion of the shaft assembly, wherein the shaft assembly retention feature is a channel formed in each of the first portion and the second portion of the housing, the channel having a front side wall defined by a first interior surface of the housing and a rear side wall defined by a second interior surface of the housing, the first interior surface spaced apart from the second interior surface and connected by a bottom surface of the channel; and a thrust air bearing disposed within the shaft assembly retention features of the first portion and the second portion of the housing, the thrust air bearing including a pair of spaced apart first components and a pair of spaced apart second components, one of the first components spaced apart from the bottom surface and secured to the front side wall of the first portion of the housing and another of the first components spaced apart from the bottom surface and secured to the rear sidewall of the first portion of the housing, and one of the second components spaced apart from the bottom surface and secured to the front side wall of the second portion of the housing and another of the second components spaced apart from the bottom surface and secured to the rear sidewall of the second portion of the housing.

11. The compressor according to claim 10, further comprising a volute coupled to at least one of the first portion and the second portion, the volute including a fluid conduit for directing a flow of a fluid, wherein the flow of the fluid is generated by the shaft assembly.

12. The compressor according to claim 10, wherein at least one of the first portion and the second portion includes a cooling feature for dissipating heat generated by compressor.

13. The compressor according to claim 12, wherein the cooling feature is a plurality of cooling channels formed in at least one of the first portion and the second portion.

14. The compressor according to claim 10, further comprising a sealing element disposed between the first portion and the second portion of the housing.

15. The compressor according to claim 10, further comprising an oil-free air bearing disposed around a circumference of the shaft assembly.

16. The compressor according to claim 15, wherein at least one of the first portion and the second portion of the housing includes a retention feature for retaining the oil-free air bearing in a substantially static position.

17. A method for producing a compressor, the method comprising the steps of:

providing a first portion of a housing adapted to receive a shaft assembly of the compressor, wherein the shaft assembly includes a thrust disk, the first portion including a shaft assembly retention feature for receiving the thrust disk to regulate a motion of the shaft assembly, wherein the shaft assembly retention feature is a channel formed in the first portion of the housing, the channel having a front side wall defined by a first interior surface of the housing and a rear side wall defined by a second interior surface of the housing, the first interior surface spaced apart from the second interior surface and connected by a bottom surface of the channel;

securing one of a pair of spaced apart first components of a thrust air bearing spaced apart from the bottom surface on to the front side wall of the shaft assembly retention feature formed in the first portion of the housing, and another of the pair of first components of the thrust bearing spaced apart from the bottom surface to the rear side wall of the shaft assembly retention feature formed in the first portion of the housing;

rotatably disposing the shaft assembly in the first portion of the housing;

providing a second portion of the housing adapted to receive the shaft assembly of the compressor, the second portion including the shaft assembly retention feature for receiving the thrust disk to regulate a motion of the shaft assembly, wherein the shaft assembly retention feature is the channel formed in the second portion of the housing, the channel having the front side wall defined by the first interior surface of the housing and the rear side wall defined by the second interior surface of the housing, the first interior surface spaced apart from the second interior surface and connected by a bottom surface of the channel;

securing one of a pair of spaced apart second components of the thrust air bearing spaced apart from the bottom surface to the front side wall of the shaft assembly retention feature formed in the second portion of the housing, and another of the pair of second components of the thrust bearing spaced apart from the bottom surface to the rear side wall of the shaft assembly retention feature formed in the second portion of the housing; and coupling the second portion of the housing to the first portion to enclose the shaft assembly therebetween.

18. The method according to claim 17, further comprising the step of coupling a volute to at least one of the first portion and the second portion, the volute including a fluid conduit for directing a flow of a fluid, wherein the flow of the fluid is generated by the shaft assembly.

* * * * *